US011004369B2

(12) United States Patent
Li

(10) Patent No.: US 11,004,369 B2
(45) **Date of Patent: *May 11, 2021**

(54) SCREEN FLICKERING PROCESSING METHOD AND DEVICE, STORAGE MEDIUM AND ELECTRONIC

(71) Applicant: GUANGDONG OPPO MOBILE TELECOMMUNICATIONS CORP., LTD., Guangdong (CN)

(72) Inventor: Ping Li, Dongguan (CN)

(73) Assignee: GUANGDONG OPPO MOBILE TELECOMMUNICATIONS CORP., LTD., Guangdong (CN)

( * ) Notice: Subject to any disclaimer, the term of this patent is extended or adjusted under 35 U.S.C. 154(b) by 0 days.

This patent is subject to a terminal disclaimer.

(21) Appl. No.: 16/573,824

(22) Filed: Sep. 17, 2019

(65) Prior Publication Data

US 2020/0020261 A1 Jan. 16, 2020

Related U.S. Application Data

(63) Continuation of application No. 16/476,864, filed as application No. PCT/CN2017/103516 on Sep. 26, 2017.

(30) Foreign Application Priority Data

Jan. 10, 2017 (CN) ..... 201710017281.5

(51) Int. Cl.
*G09G 3/00* (2006.01)
*G09G 3/36* (2006.01)

(52) U.S. Cl.
CPC ..... *G09G 3/006* (2013.01); *G09G 3/3648* (2013.01); *G09G 2320/0247* (2013.01)

(58) Field of Classification Search
CPC ..... G09G 2320/0247; G09G 3/006; G09G 3/3648; G09G 2360/145; G09G 3/3655; G09G 3/36
See application file for complete search history.

(56) References Cited

U.S. PATENT DOCUMENTS 5,943,036 A * 8/1999 Tanaka ..... G09G 5/006 345/620
6,646,628 B2 * 11/2003 Shirochi ..... H04N 9/3105 345/209

(Continued)

FOREIGN PATENT DOCUMENTS

CN 101118730 A 2/2008
CN 101739978 A 6/2010

(Continued)

*Primary Examiner* — Michael J Jansen, II
(74) *Attorney, Agent, or Firm* — Ladas & Parry, LLP

(57) ABSTRACT

A screen flickering processing method may include that: whether screen flickering occurs or not is detected (101); a reference voltage (VCOM voltage) value for liquid crystal molecule deflection of a display screen is acquired in response to detecting that screen flickering occurs (102); a difference value between the acquired VCOM voltage value and a preset VCOM voltage value is calculated (103); a target VCOM voltage value is calculated according to the acquired VCOM voltage value, the preset VCOM voltage value and the difference value (104); and the VCOM voltage value of the display screen is adjusted into the target VCOM voltage value (105). A screen flickering processing device, a storage medium and an electronic device (400) are also provided.

9 Claims, 5 Drawing Sheets

(56) References Cited

U.S. PATENT DOCUMENTS 6,727,877 B2 * 4/2004 Itakura ..... G09G 3/2011 345/209
6,747,619 B1 * 6/2004 Tanahashi ..... G09G 3/006 345/87
6,963,323 B2 * 11/2005 Sakurai ..... G09G 3/3696 345/89
7,800,603 B2 * 9/2010 Wang ..... G09G 3/3655 345/207
9,304,340 B2 * 4/2016 Dai ..... G02F 1/1309
9,311,839 B2 * 4/2016 Xu ..... G09G 3/006
9,330,627 B2 * 5/2016 Syu ..... G09G 3/3696
9,508,294 B2 * 11/2016 He ..... G09G 3/36
9,721,515 B2 * 8/2017 Syu ..... G02F 1/133
9,898,954 B2 * 2/2018 Chen ..... G09G 3/2007
10,504,584 B2 * 12/2019 Aoyama ..... H04N 21/2393
2002/0011984 A1 * 1/2002 Shirochi ..... H04N 9/312 345/96
2002/0126076 A1 * 9/2002 Itakura ..... G09G 3/2011 345/87
2002/0175662 A1 * 11/2002 Sakurai ..... G09G 3/3696 323/312
2005/0200588 A1 * 9/2005 Kaneda ..... G09G 3/3655 345/98
2006/0007194 A1 * 1/2006 Verschueren ..... G09G 3/3611 345/204
2006/0145986 A1 * 7/2006 Oh ..... G09G 3/006 345/92
2007/0057975 A1 * 3/2007 Oh ..... G09G 3/3648 345/690
2007/0139343 A1 * 6/2007 Wang ..... G09G 3/3655 345/98
2008/0273000 A1 * 11/2008 Park ..... G09G 3/006 345/89
2014/0184967 A1 * 7/2014 Xu ..... G09G 3/006 349/37
2015/0129749 A1 * 5/2015 Dai ..... G02F 1/1309 250/214 DC
2015/0206494 A1 * 7/2015 Syu ..... G09G 3/3696 345/207
2016/0267855 A1 * 9/2016 He ..... G09G 3/36
2016/0314755 A1 * 10/2016 Feng ..... G09G 3/3655
2016/0343317 A1 * 11/2016 Syu ..... G02F 1/133
2017/0162100 A1 * 6/2017 Chen ..... G09G 3/2007
2018/0114566 A1 * 4/2018 Aoyama ..... G11C 11/419
2019/0088201 A1 * 3/2019 Zhao ..... G09G 3/3696
2019/0088202 A1 * 3/2019 Zhao ..... G09G 3/3258
2019/0088231 A1 * 3/2019 Zhao ..... G09G 5/003
2019/0325830 A1 * 10/2019 Chen ..... G09G 3/3607
2019/0362663 A1 * 11/2019 Li ..... G09G 3/3655

FOREIGN PATENT DOCUMENTS

CN 102542963 A 7/2012
CN 102645771 A 8/2012
CN 202383982 U 8/2012
CN 103676231 A 3/2014
CN 103680445 A 3/2014
CN 105390107 A 3/2016
CN 205140484 U 4/2016
CN 106169281 A 11/2016
CN 106683603 A 5/2017
JP 2000215310 A 8/2000
JP 2001312242 A 11/2001

* cited by examiner

SCREEN FLICKERING PROCESSING METHOD AND DEVICE, STORAGE MEDIUM AND ELECTRONIC

CROSS-REFERENCE TO RELATED APPLICATIONS

The present application is a continuation of U.S. patent application Ser. No. 16/476,864, which is a national stage application of International Patent Application No. PCT/CN2017/103516, which is filed on Sep. 26, 2017 and claims priority to Chinese Patent Application No. 201710017281.5, filed on Jan. 10, 2017 and entitled "Screen Flickering Processing Method and Terminal", the contents of which are hereby incorporated by reference in its entirety.

TECHNICAL FIELD

Embodiments of the present disclosure relate to the technical field of communication, and particularly to a screen flickering processing method and device, a storage medium and an electronic device.

BACKGROUND

Along with aging of liquid crystals, accumulation of static electricity and the like, a screen flickering phenomenon is likely to occur to a display screen in a using process of the display screen. Such a screen flickering phenomenon may be quite serious and visible to naked eyes sometimes and thus may be manually adjusted. This phenomenon may also be relatively slight and almost invisible to naked eyes sometimes, but such a slight screen flickering phenomenon, after the screen is used for a long time, may also harm the eyes of a user badly and bring poor experiences to the user. Therefore, there is an urgent need for a method for eliminating the screen flickering phenomenon.

SUMMARY

In view of this, the embodiments of the present disclosure provide a screen flickering processing method and a terminal, which may automatically detect and eliminate a screen flickering phenomenon and improve quality of a product.

According to a first aspect, the embodiments of the present disclosure provide a screen flickering processing method, which may include that;

whether screen flickering occurs or not is detected;

a reference voltage (VCOM voltage) value for liquid crystal molecule deflection of a display screen is acquired in response to detecting that screen flickering occurs;

a difference value between the acquired VCOM voltage value and a preset VCOM voltage value is calculated;

a target VCOM voltage value is calculated according to the acquired VCOM voltage value, the preset VCOM voltage value and the difference value; and the VCOM voltage value of the display screen is adjusted into the target VCOM voltage value.

According to a second aspect, the embodiments of the present disclosure provide a screen flickering processing device, which may include:

a detection unit, configured to detect whether screen flickering occurs or not;

an acquisition unit, configured to acquire, in response to detecting that screen flickering occurs, a reference voltage (VCOM voltage) value for liquid crystal molecule deflection of a display screen;

a calculation unit, configured to calculate a difference value between the acquired VCOM voltage value and a preset VCOM voltage value and calculate a target VCOM voltage value according to the acquired VCOM voltage value, the preset VCOM voltage value and the difference value; and an adjustment unit, configured to adjust the VCOM voltage value the display screen into the target VCOM voltage value.

According to a third aspect, the embodiments of the present disclosure provide a storage medium, in which multiple instructions may be stored, the instructions being suitable to be loaded by a processor to execute the method in the first aspect.

According to a fourth aspect, the embodiments of the present disclosure provide an electronic device, which may include a processor, a memory, a display screen and a control circuit, wherein the processor may be electrically connected with the memory; the display screen and the control circuit; the memory may be configured to store an instruction and data; the display screen may be configured to display information; the control circuit may be configured to control the display screen to display the information; and the processor may be configured to execute the following, operations:

detecting whether screen flickering occurs or not, acquiring, in response to detecting that screen flickering occurs, a reference voltage (VCOM voltage) value for liquid crystal molecule deflection of the display screen, calculating a difference value between the acquired VCOM voltage value and a preset VCOM voltage value, calculating a target VCOM voltage value according to the acquired VCOM voltage value, the preset VCOM voltage value and the difference value, and adjusting the VCOM voltage value of the display screen into the target VCOM voltage value.

By virtue of the screen flickering processing method and the terminal provided by the embodiments of the present disclosure, the screen flickering phenomenon can be automatically detected and eliminated, and the quality of the product is improved.

BRIEF DESCRIPTION OF THE DRAWINGS

In order to describe the technical solutions in the embodiments of the present disclosure more clearly, the drawings required to be used for descriptions about the embodiments will be simply introduced below. It is apparent that the drawings described below are only some embodiments of the present disclosure. Those skilled in the art may further obtain other drawings according to these drawings without creative work.

DETAILED DESCRIPTION OF THE EMBODIMENTS

Figure 1A:
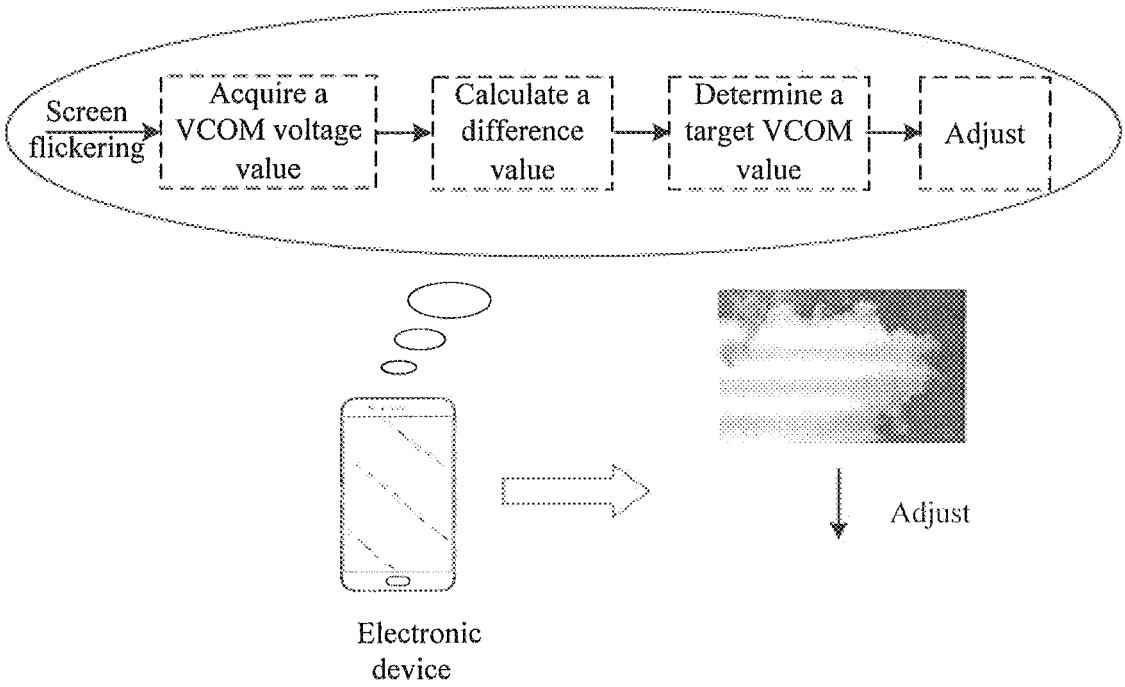
FIG. 1*a* is a schematic diagram of an application scenario of a screen flickering processing method according to an embodiment of the present disclosure.

The technical solutions in the embodiments of the present disclosure will be clearly and completely described below in combination with the drawings in the embodiments of the present disclosure. It is apparent that the described embodiments are not all embodiments but only part of embodiments of the present disclosure. All of other embodiments obtained by those skilled in the art on the basis of the embodiments in the present disclosure without creative work shall fall within the scope of protection of the present disclosure.

In related art, there is no technology for automatically detecting and processing screen flickering, and occurrence of screen flickering does direct harms to eyes of a user and brings a relatively poor user experience. Therefore, the embodiments of the present disclosure provide a screen flickering processing method and device, a storage medium and an electronic device, which may automatically detect and eliminate a screen flickering phenomenon, improve the user experience and improve quality of a product. The screen flickering processing method provided in the embodiments of the present disclosure may be applied to the screen flickering processing, device. The screen flickering processings device may be an electronic device such as a mobile phone or a tablet computer.

An embodiment of the present disclosure provides a screen flickering processing method, which may include that:

whether screen flickering occurs or not is detected;

a reference voltage (VCOM voltage) value for liquid crystal molecule deflection of a display screen is acquired in response to detecting that screen flickering occurs;

a difference value between the acquired VCOM voltage value and a preset VCOM voltage value is calculated;

a target VCOM voltage value is calculated according to the acquired VCOM voltage value, the preset VCOM voltage value and the difference value; and the VCOM voltage value of the display screen is adjusted into the target VCOM voltage value.

In an embodiment, the operation that whether screen flickering occurs or not is detected may include that:

a detection instruction is sent to the display screen to acquire the VCOM voltage value of the display screen;

whether the acquired VCOM voltage value falls within a preset voltage range or not is judged; and it is determined, in response to judging that the acquired VCOM voltage value falls within the preset voltage range, that screen flickering occurs.

In an embodiment, the operation that whether screen flickering occurs or not is detected may include that:

a grayscale image and a flicker test picture are sent to the display screen to acquire a flicker value of the display screen;

whether the acquired flicker value falls within a preset flicker range or not is judged; and it is determined, in response to judging that the acquired flicker value falls within the preset flicker range, that screen flickering occurs.

In an embodiment, the operation that whether screen flickering occurs or not is detected may include that:

a detection instruction is sent to the display screen to acquire the VCOM voltage value of the display screen, and a grayscale image and a flicker test picture are sent to the display screen to acquire a flicker value of the display screen;

whether the acquired VCOM voltage value falls within a preset voltage range or not is judged, and whether the acquired flicker value falls within a preset flicker range or not is judged; and it is determined, in response to judging that the acquired VCOM voltage value falls within the preset voltage range and the acquired flicker value falls within the preset flicker range, that screen flickering occurs.

In an embodiment, the operation that the target VCOM voltage value is calculated according to the acquired VCOM voltage value, the preset VCOM voltage value and the difference value may include that:

an average value of the acquired, VCOM voltage value and the preset VCOM voltage value is calculated;

the difference value is added to the average value to obtain a first target VCOM voltage value, and the difference value is subtracted from the average value to obtain a second target VCOM voltage value; and a voltage value closer to the preset VCOM voltage value is selected from the first target VCOM voltage value and the second target VCOM voltage value as the target VCOM voltage value.

In an embodiment, after the operation that the target VCOM voltage value is calculated according to the acquired VCOM voltage value, the preset VCOM voltage value and the difference value, the method may further include that:

an adjustment step length is determined according to the acquired VCOM voltage value and the target VCOM voltage value.

In an embodiment, the operation that the VCOM voltage value of the display screen is adjusted into the target VCOM voltage value may include that:

the VCOM voltage value of the display screen is adjusted into the target VCOM voltage value by adjusting a register value of the display screen according to the adjustment step length.

In an exemplary application scenario of the screen flickering processing method provided in the embodiment of the present disclosure, as shown in FIG. 1*a*, the electronic device may detect whether screen flickering occurs or not, acquire, in response to detecting that screen flickering occurs, the reference voltage (VCOM voltage) value for liquid crystal molecule deflection of the display screen, calculate the difference value between the acquired VCOM voltage value and the preset VCOM voltage value, calculate the target VCOM voltage value according to the acquired VCOM voltage value, the preset VCOM voltage value and the difference value and adjust the VCOM voltage value of the display screen into the target VCOM voltage value. After adjustment, for example, as shown in FIG. 1*a*, the screen flickering phenomenon disappears, and contents are displayed normally on the display screen.

Figure 1B:
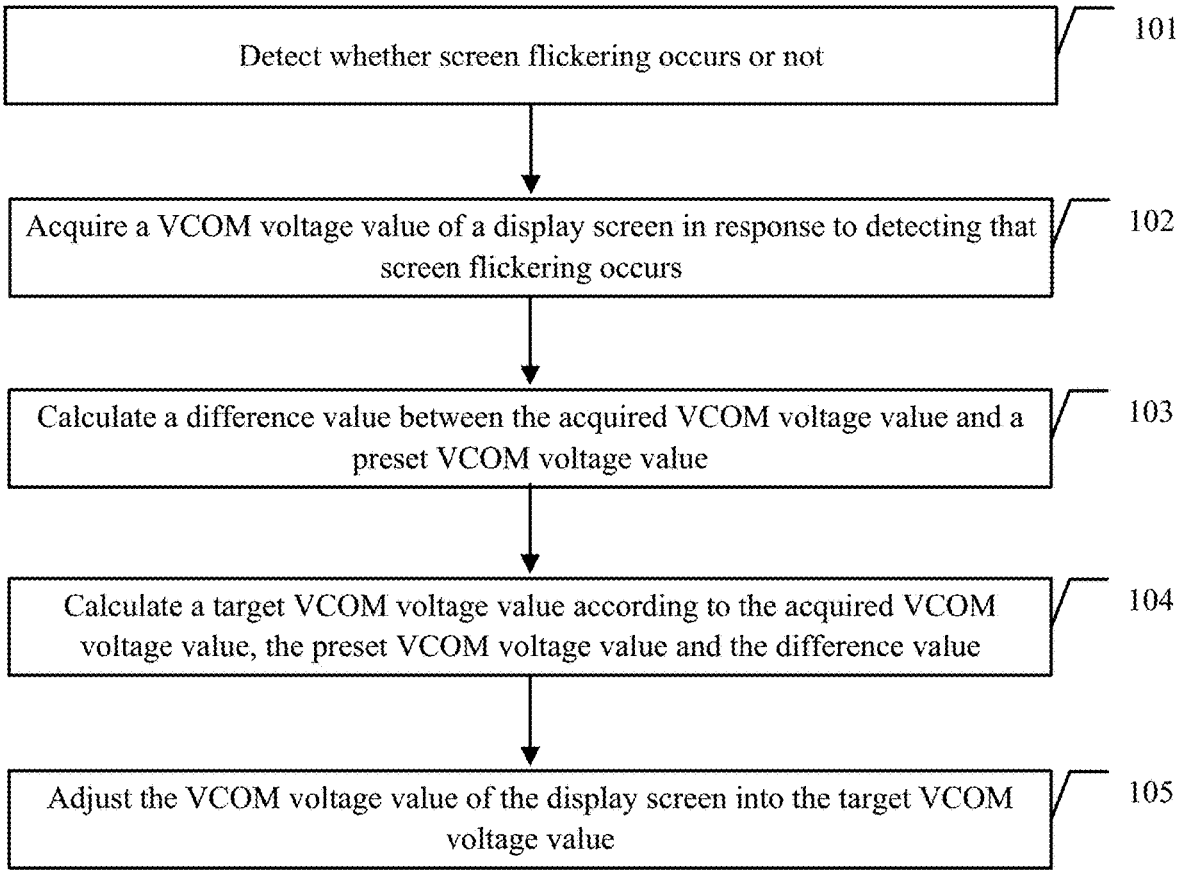
FIG. 1*b* is a flowchart of a screen flickering processing method according to an embodiment of the present disclosure.

In an exemplary embodiment, a screen flickering processing method is provided, and as shown in FIG. 1*b*, includes the following operations 101 to 105.

In operation 101, a VCOM voltage value of a display screen is acquired.

In operation 102, whether screen flickering occurs or not is detected.

It is found from practices and researches that a VCOM voltage (reference voltage for liquid crystal molecule deflection) may directly affect liquid crystal display and modifying a VCOM voltage value may greatly improve or worsen a screen flickering phenomenon of a display screen. Therefore, the VCOM voltage value of the display screen is detected to judge whether screen flickering occurs or not in the embodiment.

Flicker is a hardware index for testing flickering of the display screen. In the embodiment, a flicker value of the display screen may also be detected to judge whether screen flickering occurs or not. Of course, during a practical application, the VCOM voltage value of the display screen and the flicker value may also be combined to judge whether screen flickering occurs or not, to improve screen flickering detection accuracy.

There are many reasons for screen flickering, for example, a hardware failure, a backlight problem, accumulation and interference of static electricity, unstable charges in liquid crystals of the display screen and aging of the liquid crystals of the display screen. In the embodiment, screen flickering caused by unstable charges in the liquid crystals of the display screen and aging of the liquid crystals of the display screen is mainly detected and addressed.

The VCOM voltage value is stored in a register of a hardware circuit of the display screen. Therefore, a detection instruction may be sent to the display screen to trigger the display screen to read and return the value in the register, and then the VCOM voltage value of the display screen is acquired according to data returned by the display screen.

In operation 103, a difference value between the acquired VCOM voltage value and a preset VCOM voltage value is calculated in response to detecting that screen flickering occurs.

The preset VCOM voltage value may be a voltage value, obtained theoretically or practically in a state with a relatively good or optimal display effect, of the VCOM.

In operation 103, a target VCOM voltage value is calculated according to the acquired VCOM voltage value, the preset VCOM voltage value and the difference value.

As an exemplary implementation, an average value of the acquired VCOM voltage value and the preset VCOM voltage value may be calculated at first, the difference value is added to the average value to obtain a first target VCOM voltage value, the difference value is subtracted from the average value to obtain a second target VCOM voltage value, and a voltage value closer to the preset VCOM voltage value is selected from the first target VCOM voltage value and the second target VCOM voltage value as the target VCOM voltage value.

For example, when the acquired VCOM voltage value is 96 and the preset VCOM voltage value is 100, the difference value between the acquired VCOM voltage value and the preset VCOM voltage value is 4, the average value is 98, the first target VCOM voltage value is 98+4=102, the second target VCOM voltage value is 98−4=94, a difference value between the first target VCOM voltage value and the preset VCOM voltage value is 2 and a difference value between the second target VCOM voltage value and the preset VCOM voltage value is 6. It is apparent that the first target VCOM voltage value 102 is closer to the preset VCOM voltage value 100, so that the first target VCOM voltage value 102 is taken as the target VCOM voltage value.

In operation 104, the VCOM voltage value of the display screen is adjusted into the target VCOM voltage value.

The VCOM voltage value is stored in the register of the hardware circuit of the display screen, so that the VCOM voltage value of the display screen is adjusted into the target VCOM voltage value by adjusting a register value of the display screen.

In the embodiment, whether screen flickering occurs or not may be automatically detected, and in response to detecting that screen flickering occurs, the target VCOM voltage value is automatically calculated according to the VCOM voltage value of the display screen and the preset VCOM voltage value, and the VCOM voltage value of the display screen is directly adjusted into the target VCOM voltage value to eliminate the screen flickering phenomenon, thereby improving a user experience and improving quality of a product.

Figure 2:
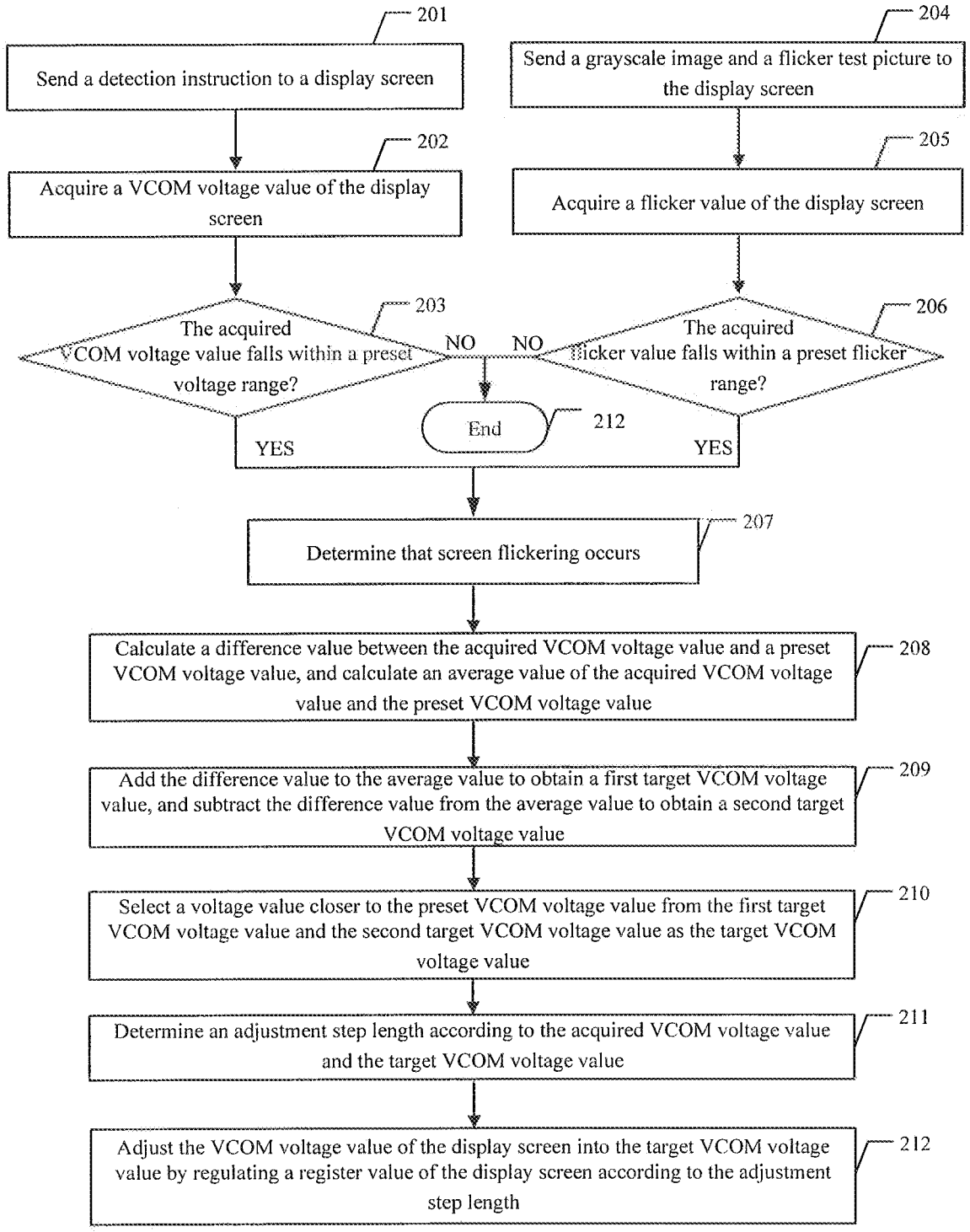
FIG. 2 is another flowchart of a screen flickering processing method according to an embodiment of the present disclosure.

The method described in the abovementioned embodiment will be further described in the embodiment. As shown in FIG. 2, the method of the embodiment includes the following operations 201 to 212.

In operation 201, a detection instruction is sent to a display screen.

In operation 202, a VCOM voltage value of the display screen is acquired.

The VCOM voltage value is stored in a register of a hardware circuit of the display screen, so that a detection instruction may be sent to the display screen to trigger the display screen to read and return the value in the register, and then the VCOM voltage value of the display screen is acquired according to data returned by the display screen.

In operation 203, whether the acquired VCOM voltage value falls within a preset voltage range or not is judged, operation 207 is executed in response to judging that the acquired VCOM voltage value falls within the preset voltage range, and operation 212 is executed to end processing in response to judging that the acquired VCOM voltage value does not fall within the preset voltage range.

During practical implementation, a preset VCOM voltage value may be provided, and voltage values within plus and minus preset numerical values (for example, 3% and 5%) of the preset VCOM voltage value may form the preset voltage range. The preset VCOM voltage value may be a voltage value, obtained theoretically or practically in a state with a relatively good or optimal display effect, of the VCOM. For example, the preset VCOM voltage value is 100, the preset voltage range may be [97,100) and (100,103] (i.e., plus and minus 3% of the preset VCOM voltage value), or the preset voltage range may be [95,100) and (100,105] (i.e., plus and minus 5% of the preset VCOM voltage value). In the above example, if the acquired VCOM voltage value is 98, it falls within the preset voltage range; and if the acquired VCOM voltage value is 92, it does not fall within the preset voltage range. When the acquired VCOM voltage value does not fall within the preset voltage range, no processing is temporarily executed, namely, processing is ended.

In operation 204, a grayscale image and a flicker test picture are sent to the display screen.

In operation 205, a flicker value of the display screen is acquired.

A grayscale image and a flicker test picture, after being sent to the display screen, may be displayed on the display screen. Then, the display screen may feed back regular voltage values of the register, these regular voltage values including vgl and, vgh (on and off voltages of switching tubes on pixels), vsn and vsp (positive and negative liquid crystal drive power voltages) and the like. Whether these regular voltage values are the same as corresponding preset voltage values (the preset voltage values are theoretical voltage values after the grayscale image and the flicker test picture are displayed on the display screen) or not is judged. If these regular voltage values are the same as the corresponding preset voltage values (probably no screen flickering occurs), processing is ended. If these regular voltage values are not the same as the corresponding preset voltage values, flicker values corresponding to these regular voltage values are acquired according to a prestored corresponding relationship (i.e., a corresponding relationship between a voltage value and a flicker value), and whether the acquired flicker values fall within the preset flicker range or not is judged. The preset flicker range may be obtained by presetting a flicker value and extracting flicker values within plus and minus preset numerical values (for example, 3% and 5%) of the preset flicker value. For example, the preset flicker value is 50, and the preset flicker range may be [48.5,50) and (50,51.5] (i.e, plus and minus 3% of the preset flicker value), or the preset flicker range may be [47.5,50) and (50,52.5] (i.e., plus and minus 5% or the preset flicker value). In the above example, if the acquired flicker value is 49, it falls within the preset flicker range; and if the acquired flicker value is 42, it does not fall within the preset flicker range. When the acquired flicker value does not fall within the preset flicker range, no processing is temporarily executed, namely processing is ended.

In operation 206, whether the acquired flicker value falls within a preset flicker range or not is judged, operation 207 is executed in response to judging that the acquired flicker value falls within the preset flicker range, and operation 212 is executed to end processing in response to judging that the acquired flicker value does not fall within the preset flicker range.

In operation 207, it is determined that screen flickering occurs.

It is to be noted that, during practical implementation, whether screen flickering occurs or not may be judged only based on the VCOM voltage value of the display screen, namely only operations 201-203 are executed in a screen flickering detection process. Alternatively, whether screen flickering occurs or not may also be judged only based on a flicker value of the display screen, namely only operations 204-206 are executed in the screen flickering detection process. Of course, the VCOM voltage value of the display screen may also be combined with the flicker value to judge whether screen flickering occurs or not, namely operations 201-203 and operations 204-206 are all executed in the screen flickering detection process, so that the screen flickering detection accuracy may be improved.

There are many reasons for screen flickering, for example, a hardware failure, a backlight problem, accumulation and interference of static electricity, unstable charges in liquid crystals of the display screen and aging of the liquid crystals of the display screen. In the embodiment, screen flickering caused by unstable charges in the liquid crystals of the display screen and aging of the liquid crystals of the display screen is mainly detected and addressed. In the above operations, when the VCOM voltage value of the display screen does not fall within the preset voltage range or the flicker value of the display screen does not fall within the preset flicker range screen flickering caused by the hardware failure or for other reasons may occur, and for screen flickering of this type, no processing may temporarily be executed in the embodiment.

In operation 208, a difference value between the acquired VCOM voltage value and the preset VCOM voltage value is calculated, and an average value of the acquired VCOM voltage value and the preset VCOM voltage value is calculated.

In operation 209, the difference value is added to the average value to obtain a first target VCOM voltage value, and the difference value is subtracted from the average value to obtain a second target VCOM voltage value.

In operation 210, a voltage value closer to the preset VCOM voltage value is selected from the first target VCOM voltage value and the second target VCOM voltage value as the target VCOM voltage value.

For example, when the acquired VCOM voltage value is 102 and the preset VCOM voltage value is 100, the difference value between the acquired VCOM voltage value and the preset VCOM voltage value is 2, the average value is 101, the first target VCOM voltage value is 101+2=103, the second target VCOM voltage value is 101-2=99, a difference value between the first target VCOM voltage value and the preset VCOM voltage value is 3 and a difference value between the second target VCOM voltage value and the preset VCOM voltage value is 1. It is apparent that the second target VCOM voltage value 99 is closer to the preset VCOM voltage value 100, therefore the second target VCOM voltage value 99 is taken as the target VCOM voltage value.

In operation 211, an adjustment step length is determined according to the acquired VCOM voltage value and the target VCOM voltage value.

As an exemplary implementation, the adjustment step length may be determined according to the difference value between the acquired VCOM voltage value and the target VCOM voltage value. For example, when the difference value between the acquired VCOM voltage value and the target VCOM voltage value is 3, it may be determined that the adjustment step length is 1. When the difference value between the acquired VCOM voltage value and the target VCOM voltage value is 0.3, it may be determined that the adjustment step length is 0.1.

In operation 212, the VCOM voltage value of the display screen is adjusted into the target VCOM voltage value by adjusting a register value of the display screen according to the adjustment step length.

The VCOM voltage value is stored in the register of the hardware circuit of the display screen, so that the VCOM voltage value of the display screen can be adjusted into the target VCOM voltage value by adjusting the register value of the display screen according to the determined adjustment step length.

In the embodiment, whether screen flickering occurs or not may be automatically detected, and in response to detecting that screen flickering occurs, the target VCOM voltage value is automatically calculated according to the VCOM voltage value of the display screen and the preset VCOM voltage value, and the VCOM voltage value of the display screen is directly adjusted into the target VCOM voltage value to eliminate the screen flickering phenomenon, thereby improving a user experience and improving quality of a product.

An embodiment of the present disclosure also provides a screen flickering processing device, which includes a detection unit, an acquisition unit, a calculation unit and an adjustment, unit.

The detection unit is configured to detect whether screen flickering occurs or not.

The acquisition unit is configured to acquire, in response to detecting that screen flickering occurs, a reference voltage (VCOM voltage) value for liquid crystal molecule deflection of a display screen.

The calculation unit is configured to calculate a difference value between the acquired VCOM voltage value and a preset VCOM voltage value and calculate a target VCOM voltage value according to the acquired VCOM voltage value, the preset VCOM voltage value and the difference value.

The adjustment unit is configured to adjust the VCOM voltage value of the display screen into the target VCOM voltage value.

In an embodiment, the detection unit includes:

a sending subunit, configured to send a detection instruction to the display screen to acquire the VCOM voltage value of the display screen and send a grayscale image and a flicker test picture to the display screen to acquire a flicker value of the display screen;

a judgment subunit, configured to judge whether the acquired VCOM voltage value falls within a preset voltage range or not and judge whether the acquired flicker value falls within a preset flicker range or not; and a determination subunit, configured to, when the acquired VCOM voltage value falls within the preset voltage range and the acquired flicker value falls within the preset flicker range, determine that screen flickering occurs.

In an embodiment, the calculation unit includes:

a calculation subunit, configured to calculate the difference value between the acquired VCOM voltage value and the preset VCOM voltage value and calculate an average value of the acquired VCOM voltage value and the preset VCOM voltage value;

a candidate value acquisition subunit, configured to add the difference value to the average value to obtain a first target VCOM voltage value and subtract the difference value from the average value to obtain a second target VCOM voltage value; and a target value acquisition subunit, configured to select a voltage value closer to the preset VCOM voltage value from the first target VCOM voltage value and the second target VCOM voltage value as the target VCOM voltage value.

In an embodiment, the device further includes:

a determination unit, configured to determine an adjustment step length according to the acquired VCOM voltage value and the target VCOM voltage value.

In an embodiment, the adjustment unit is configured to:

adjust the VCOM voltage value of the display screen into the target VCOM voltage value by adjusting a register value of the display screen according to the adjustment step length.

Figure 3:
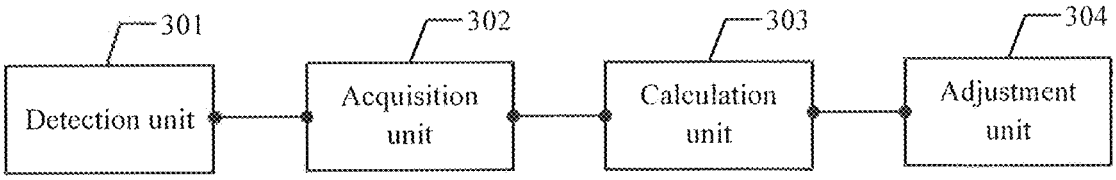
FIG. 3 is a structure diagram of a screen flickering processing device according to an embodiment of the present disclosure.

In an exemplary embodiment, a screen flickering processing device is also provided. The screen flickering processing device may be integrated in an electronic device, and the electronic device may be a smart phone, a tablet computer and the like. As shown in FIG. 3, the screen flickering processing device includes:

a detection unit 301, configured to detect whether screen flickering occurs or not;

an acquisition unit 302, configured to acquire, in response to detecting that screen flickering occurs, a reference voltage (VCOM voltage) value for liquid crystal molecule deflection of a display screen;

a calculation unit 303, configured to calculate a difference value between the acquired VCOM voltage value and a preset VCOM voltage value and calculate a target VCOM voltage value according to the acquired VCOM voltage value, the preset VCOM voltage value and the difference value; and an adjustment unit 304, configured to adjust the VCOM voltage value of the display screen into the target VCOM voltage value.

Figure 4:
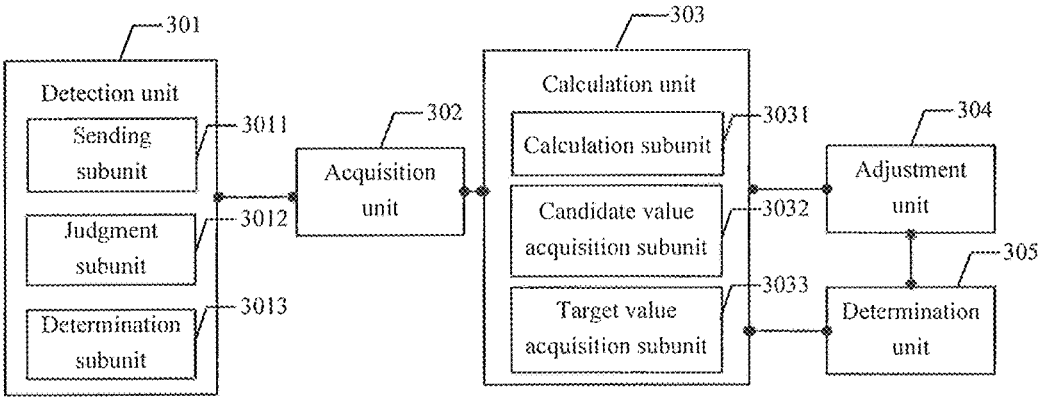
FIG. 4 is another structure diagram of a screen flickering processing device according to an embodiment of the present disclosure.

In an exemplary embodiment, as shown in FIG. 4, the detection unit 301 includes:

a sending subunit 3011, configured to send a detection instruction to the display screen to acquire the VCOM voltage value of the display screen;

a judgment subunit 3012, configured to judge whether the acquired VCOM' voltage value falls within a preset voltage range or not; and a determination subunit 3013, configured to determine, in response to judging that the acquired VCOM voltage value falls within the preset voltage range, that screen flickering occurs.

In an exemplary embodiment, as shown in FIG. 4, the detection unit 301 includes:

the sending subunit 3011, configured to send a grayscale image and a flicker test picture to the display screen to acquire a flicker value of the display screen;

the judgment subunit 3012, configured to judge whether the acquired flicker value falls within a preset flicker range or not; and the determination subunit 3013, configured to determine, in response to judging that the acquired flicker value falls within the preset flicker range, that screen flickering occurs.

In an exemplary embodiment, as shown in FIG. 4, the detection unit 301 includes:

the sending subunit 3011, configured to send a detection instruction to the display screen to acquire the VCOM voltage value of the display screen and send a grayscale image and a flicker test picture to the display screen to acquire a flicker value of the display screen;

the judgment subunit 3012, configured to judge whether the acquired VCOM voltage value falls within a preset voltage range or not and judge whether the acquired flicker value falls within a preset flicker range or not; and the determination subunit 3013, configured to determine, in response to judging that the acquired VCOM voltage value falls within the preset voltage range and the acquired flicker value falls within the preset flicker range, that screen flickering occurs.

In an exemplary embodiment, as shown in FIG. 4, the calculation unit 303 includes:

a calculation subunit 3031, configured to calculate the difference value between the acquired VCOM voltage value and the preset VCOM voltage value and calculate an average value of the acquired VCOM voltage value and the preset VCOM voltage value;

a candidate value acquisition subunit 3032, configured to add the difference value to the average value to obtain a first target VCOM voltage value and subtract the difference value from the average value to obtain a second target VCOM voltage value; and a target value acquisition subunit 3033, configured to select a voltage value closer to the preset VCOM voltage value from the first target VCOM voltage value and the second target VCOM voltage value as the target VCOM voltage value.

In an embodiment, the device further includes a determination unit 305, and the determination unit 305 is configured to determine an adjustment step length according to the acquired VCOM voltage value and the target VCOM voltage value.

In an exemplary embodiment, the adjustment unit 304 is configured to:

adjust the VCOM voltage value of the display screen into the target VCOM voltage value by adjusting a register value of the display screen according to the adjustment step length.

It is to be noted that the screen flickering processing device provided in the abovementioned embodiment is divided into each of the abovementioned function modules for exemplary description during screen flickering processing and, during a practical application, the abovementioned functions may be allocated to different function modules for realization according to a requirement, namely an internal structure of the device may be divided into different function modules to realize all or part of the functions described above. In addition, the screen flickering processing device provided in the abovementioned embodiment belongs to the same concept of the screen flickering processing method, details about exemplary implementation processes thereof may refer to the method embodiment and no more elaborations will be made herein.

In the embodiment, the detection unit may automatically detect whether screen flickering occurs or not, and in response to detecting that screen flickering occurs, the calculation unit automatically calculates the target VCOM voltage value according to the VCOM voltage value of the display screen and the preset VCOM voltage value, and the adjustment unit directly adjusts the VCOM voltage value of the display screen into the target VCOM voltage value to eliminate the screen flickering phenomenon, thereby improving a user experience and improving quality of a product.

An embodiment of the present disclosure also provides an electronic device, which includes a processor and a memory. The memory stores multiple instructions. The processor loads the instructions in the memory to execute the following operations:

detecting whether screen flickering occurs or not;

acquiring, in response to detecting that screen flickering occurs, a reference voltage (VCOM voltage) value for liquid crystal molecule deflection of the display screen;

calculating a difference value between the acquired VCOM voltage value and a preset VCOM voltage value;

calculating a target VCOM voltage value according to the acquired VCOM voltage value, the preset VCOM voltage value and the difference value; and adjusting the VCOM voltage value of the display screen into the target VCOM voltage value.

Figure 5:
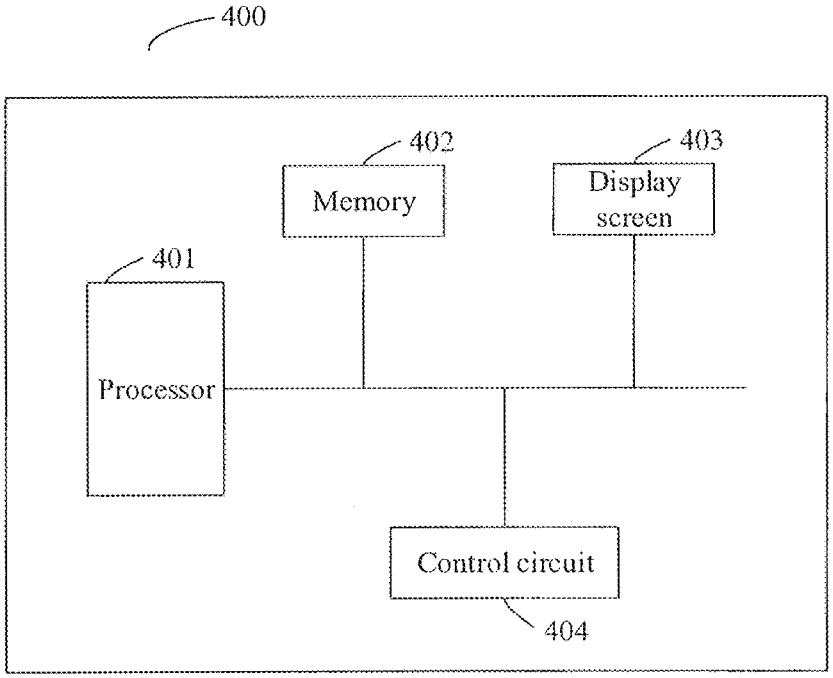
FIG. 5 is a structure diagram of an electronic device according to an embodiment of the present disclosure.

In an exemplary embodiment, an electronic device is also provided. The electronic device may be a terminal and, for example, may be a device like a smart phone and a tablet computer. As shown in FIG. 5, the electronic device 400 includes a processor 401, a memory 402, a display screen 403 and a control circuit 404. The processor 401 is electrically connected with the memory 402, the display screen 403 and the control circuit 404.

The processor 401 is a control center of the electronic device 400, connects each part of the whole electronic device by use of various interfaces and lines, and executes various functions and data processing of the electronic device by running or loading application programs stored in the memory 402 and calling data stored in the memory 402, thereby monitoring the whole electronic device.

In the embodiment, the processor 401 in the electronic device 400 may load instructions corresponding to a process of one or more than one application program into the memory 402 according to the following operations, and the processor 401 runs the application programs stored in the memory 402, thereby realizing various functions:

detecting whether screen flickering occurs or not;

acquiring, in response to detecting that screen flickering occurs, a reference voltage (VCOM voltage) value for liquid crystal molecule deflection of the display screen;

calculating a difference value between the acquired VCOM voltage value and a preset VCOM voltage value;

calculating a target VCOM voltage value according to the acquired VCOM voltage value, the preset VCOM voltage value and the difference value; and adjusting the VCOM voltage value of the display screen into the target VCOM voltage value.

In some embodiments, when detecting whether screen flickering occurs or not, the processor 401 is configured to execute the following operations:

sending a detection instruction to the display screen to acquire the VCOM voltage value of the display screen;

judging whether the acquired VCOM voltage value falls within a preset voltage range or not; and determining, in response to judging that the acquired VCOM voltage value falls within the preset voltage range, that screen flickering occurs.

In some embodiments, when detecting whether screen flickering occurs or not, the processor 401 is configured to execute the following operations:

sending a grayscale image and a flicker test picture to the display screen to acquire a flicker value of the display screen;

judging whether the acquired flicker value falls within a pre set flicker ran e or not; and determining, in response to judging that the acquired flicker value falls within the preset flicker range, that screen flickering occurs.

In some embodiments, when detecting whether screen flickering occurs or not, the processor 401 is configured to execute the following operations:

sending a detection instruction to the display screen to acquire the VCOM voltage value of the display screen, and sending a grayscale image and a flicker test picture to the display screen to acquire a flicker value of the display screen;

judging whether the acquired VCOM voltage value falls within a preset voltage range or not, and judging whether the acquired flicker value falls within a preset flicker range or not; and determining, in response to judging that the acquired VCOM voltage value falls within the preset voltage range and the acquired flicker value falls within the preset flicker range, that screen flickering occurs.

In some embodiments, when calculating the target VCOM voltage value according to the acquired VCOM voltage value, the preset VCOM voltage value and the difference value, the processor 401 is configured to execute the following operations:

calculating an average value of the acquired VCOM voltage value and the preset VCOM voltage value;

adding the difference value to the average value to obtain a first target VCOM voltage value, and subtracting the difference value from the average value to obtain a second target VCOM voltage value; and selecting a voltage value closer to the preset VCOM voltage value from the first target VCOM voltage value and the second target VCOM voltage value as the target VCOM voltage value.

In some embodiments, after calculating the target VCOM voltage value according to the acquired VCOM voltage value, the preset VCOM voltage value and the difference value, the processor 401 is further configured to execute the following operation:

determining an adjustment step length according to the acquired VCOM voltage value and the target VCOM voltage value.

In some embodiments, when adjusting the VCOM voltage value of the display screen into the target VCOM voltage value, the processor 401 is configured to execute the following operation:

adjusting the VCOM voltage value of the display screen into the target VCOM voltage value by adjusting a register value of the display screen according to the adjustment step length.

The memory 402 may be configured to store the application programs and the data. The application programs stored in the memory 402 include the instructions executable in the processor. The application programs may form various function modules. The processor 401 runs the application programs stored in the memory 402, thereby executing various function applications and data processing.

The display screen 403 may be configured to display information input by a user or information provided for the user and various graphical user interfaces of the terminal, and these graphical user interfaces may be formed by images, texts, icons, videos and any combination thereof.

The control circuit 404 is electrically connected with the display screen 403, and is configured to control the display screen 403 to display the information.

Figure 6:
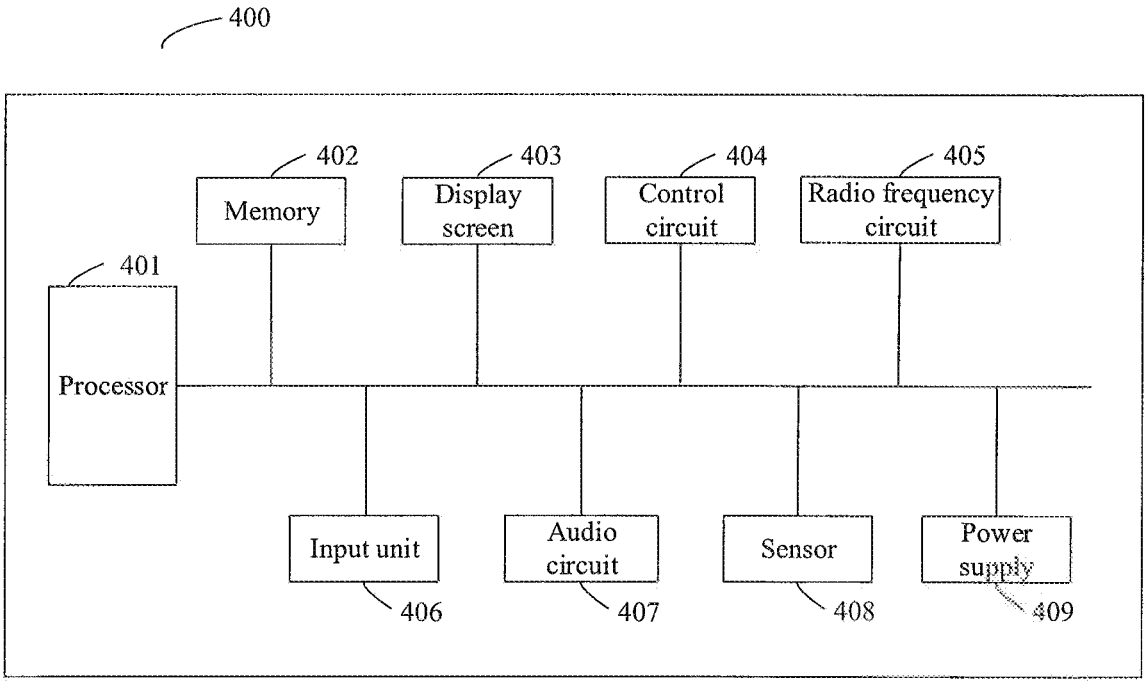
FIG. 6 is another structure diagram of an electronic device according to an embodiment of the present disclosure.

In some embodiments, as shown in FIG. 6, the electronic device 400 further includes a radio frequency circuit 405, an input unit 406, an audio circuit 407, a sensor 408 and a power supply 409. The processor 401 is electrically connected with the radio frequency circuit 405, the input unit 406, the audio circuit 407, the sensor 408 and the power supply 409 respectively.

The radio frequency circuit 405 is configured to transmit and receive a radio frequency signal to establish wireless communication with a network device or another electronic device and implement signal transmission and reception with the network device or the other electronic device by wireless communication.

The input unit 406 may be configured to receive input digital and character information or user feature information (for example, a fingerprint) and generate keyboard, mouse, operating lever, optical or track ball signal input related to user setting and function control. The input unit 406 may include a fingerprint recognition module.

The audio circuit 407 may provide an audio interface between the user and the terminal through a speaker and a microphone.

The electronic device 400 may further include at least one sensor 408, for example, a light sensor, a motion sensor and another sensor. In at least one exemplary embodiment, the light sensor may include an ambient light sensor and a proximity sensor. The ambient light sensor may adjust brightness of a display panel according to ambient light, and the proximity sensor may turn off the display panel and/or backlight when the terminal moves to the ear. As a motion sensor, a gravitational acceleration sensor may detect a magnitude of an acceleration in each direction (usually three axes), may detect a magnitude and direction of the gravity in a still state, and may be configured for mobile phone posture recognition applications (for example, landscape and portrait switching, related games and magnetometer posture calibration), vibration recognition related functions (for example, a pedometer and knocking) and the like. The other sensor, such as a gyroscope, an air gauge, a hygrometer, a thermometer and an infrared sensor, of the terminal will not be elaborated herein.

The power supply 409 is configured to supply power to each part of the electronic device 400. In some embodiments, the power supply 409 may be logically connected with the processor 401 through a power management system, thereby realizing functions of charging and discharging management, power consumption management and the like through the power management system.

The electronic device 400 may further include a camera, a Bluetooth module and the like, which are not shown in FIG. 6 and will not be elaborated herein.

The electronic device provided in the embodiments of the present disclosure may automatically detect whether screen flickering occurs or not, and in response to detecting that screen flickering occurs, automatically calculates the target VCOM voltage value according to the VCOM voltage value of the display screen and the preset VCOM voltage value, and directly adjusts the VCOM voltage value of the display screen into the target VCOM voltage value to eliminate the screen flickering phenomenon, thereby improving a user experience and improving quality of a product.

In some embodiments provided by the application, it should be understood that the disclosed system, device and method may be implemented in another manner. for example, the device embodiment described above is only schematic. For example, division of the units is only logic function division, and other division manners may be adopted during practical implementation. For example, multiple units or components may be combined or integrated into another system, or some characteristics may be neglected or not executed. In addition, displayed or discussed mutual coupling or direct coupling or communication connection may be indirect coupling or communication connection, implemented through some interfaces, of the device or the units, and may be electrical and mechanical or adopt other forms. The units described as separate parts may or may not be physically separated, and parts displayed as units may or may not be physical units, and namely may be located in the same place, or may also be distributed to multiple network units. Part or all of the units may be selected to achieve the purpose of the solutions of the embodiments according to a practical requirement.

In addition, each function unit in each embodiment of the present disclosure may be integrated into a processing unit, each unit may also independently physically exist, and two or more than two unit may also be integrated into a unit. The integrated unit may be implemented in a hardware form, and may also be implemented in form of hardware and software function unit. When being implemented in form of software function device and sold or used as an independent product, the integrated unit may be stored in a computer-readable storage medium. Based on such an understanding, the technical solutions of the present disclosure substantially or parts making contributions to the conventional art or all or part of the technical solutions may be embodied in form of software product, and the computer software product is stored in a storage medium, including a plurality of instructions configured to enable a computer device (which may be a personal computer, a server, a network device or the like) to execute all or part of the operations of the method in each embodiment of the present disclosure. The storage medium includes: various media capable of storing program codes such as a U disk, a mobile hard disk, a Read-Only Memory (ROM), a Random Access Memory (RAM), a magnetic disk or an optical disk.

As described above, the above embodiments are adopted not to limit but, only to describe the technical solutions of the present disclosure. Although the present disclosure has been described with reference to the embodiments in detail, those of ordinary skill in the art should know that modifications to the technical solutions recorded in each embodiment or equivalent replacements to part of technical characteristics therein may still be made and these modifications or replacements are made with the essence of the corresponding technical solutions kept within the spirit and scope of the technical solutions of each embodiment of the present disclosure.

What is claimed is:

1. A screen flickering processing method, comprising:

detecting whether screen flickering occurs;

calculating, in response to detecting that screen flickering occurs, a difference value between an acquired VCOM voltage value for liquid crystal molecule deflection of a display screen and a preset VCOM voltage value;

calculating a target VCOM voltage value according to the acquired VCOM voltage value, the preset VCOM voltage value and the difference value, wherein calculating the target VCOM voltage value according to the acquired VCOM voltage value, the preset VCOM voltage value and the difference value comprises: calculating an average value of the acquired VCOM voltage value and the preset VCOM voltage value; adding the difference value to the average value to obtain a first target VCOM voltage value, and subtracting the difference value from the average value to obtain a second target VCOM voltage value; and selecting a voltage value closer to the preset VCOM voltage value from the first target VCOM voltage value and the second target VCOM voltage value as the target VCOM voltage value; and Determining an adjustment step length according to the acquired VCOM voltage value and the target VCOM voltage value;

adjusting the VCOM voltage value of the display screen into the target VCOM voltage value by adjusting a register value of the display screen according to the adjustment step length.

2. The method as claimed in claim 1, wherein detecting whether screen flickering occurs comprises:

sending a detection instruction to the display screen to acquire the VCOM voltage value of the display screen;

judging whether the acquired VCOM voltage value falls within a preset voltage range; and determining, in response to judging that the acquired VCOM voltage value falls within the preset voltage range, that screen flickering occurs.

3. The method as claimed in claim 1, wherein detecting whether screen flickering occurs comprises:

sending a grayscale image and a flicker test picture to the display screen to acquire a flicker value of the display screen;

judging whether the acquired flicker value falls within a preset flicker range; and determining, in response to judging that the acquired flicker value falls within the preset flicker range, that screen flickering occurs.

4. The method as claimed in claim 1, wherein detecting whether screen flickering occurs comprises:

sending a detection instruction to the display screen to acquire the VCOM voltage value of the display screen, and sending a grayscale image and a flicker test picture to the display screen to acquire a flicker value of the display screen;

judging whether the acquired VCOM voltage value falls within a preset voltage range, and judging whether the acquired flicker value falls within a preset flicker range; and determining, in response to judging that the acquired VCOM voltage value falls within the preset voltage range and the acquired flicker value falls within the preset flicker range, that screen flickering occurs.

5. A non-transitory storage medium, storing multiple instructions, the instructions being suitable to be loaded by a processor to execute the method as claimed in claim 1.

6. A screen flickering processing device, the device has a hardware processor configured to execute program instructions stored on a memory, the program instructions comprise:

detecting whether screen flickering occurs;

calculating, in response to detecting that screen flickering occurs, a difference value between an acquired VCOM voltage value for liquid crystal molecule deflection of a display screen and a preset VCOM voltage value and calculate a target VCOM voltage value according to the acquired VCOM voltage value, the preset VCOM voltage value and the difference value, wherein the calculation unit comprises: a calculation subunit, configured to calculate the difference value between the acquired VCOM voltage value and the preset VCOM voltage value and calculate an average value of the acquired VCOM voltage value and the preset VCOM voltage value; a candidate value acquisition subunit, configured to add the difference value to the average value to obtain a first target VCOM voltage value and subtract the difference value from the average value to obtain a second target VCOM voltage value; and a target value acquisition subunit, configured to select a voltage value closer to the preset VCOM voltage value from the first target VCOM voltage value and the second target VCOM voltage value as the target VCOM voltage value; and adjusting the VCOM voltage value of the display screen into the target VCOM voltage value by adjusting a register value of the display screen according to the adjustment step length.

7. The terminal as claimed in claim 6, wherein the program instructions comprise:

sending a detection instruction to the display screen to acquire the VCOM voltage value of the display screen;

judging whether the acquired VCOM voltage value falls within a preset voltage range; and determining, in response to judging that the acquired VCOM voltage value falls within the preset voltage range, that screen flickering occurs.

8. The terminal as claimed in claim 6, wherein the program instructions comprise:

sending a grayscale image and a flicker test picture to the display screen to acquire a flicker value of the display screen;

judging whether the acquired flicker value falls within a preset flicker range; and determining, in response to judging that the acquired flicker value falls within the preset flicker range, that screen flickering occurs.

9. The device as claimed in claim 6, wherein the program instructions comprise:

sending a detection instruction to the display screen to acquire the VCOM voltage value of the display screen and send a grayscale image and a flicker test picture to the display screen to acquire a flicker value of the display screen;

judging whether the acquired VCOM voltage value falls within a preset voltage range and judge whether the acquired flicker value falls within a preset flicker range; and determining, in response to judging that the acquired VCOM voltage value falls within the preset voltage range and the acquired flicker value falls within the preset flicker range, that screen flickering occurs.

* * * * *